US007994985B2

(12) United States Patent
Luk et al.

(10) Patent No.: US 7,994,985 B2
(45) Date of Patent: Aug. 9, 2011

(54) ISOLATION ENHANCEMENT TECHNIQUE FOR DUAL-POLARIZED PROBE-FED PATCH ANTENNA

(75) Inventors: Kwai Man Luk, Kowloon (HK); Ka Leung Lau, Tai Po (HK)

(73) Assignee: City University of Hong Kong, Hong Kong (HK)

( * ) Notice: Subject to any disclaimer, the term of this patent is extended or adjusted under 35 U.S.C. 154(b) by 259 days.

(21) Appl. No.: 12/471,691

(22) Filed: May 26, 2009

(65) Prior Publication Data

US 2010/0302104 A1 Dec. 2, 2010

(51) Int. Cl.
*H01Q 1/38* (2006.01)

(52) U.S. Cl. ..... 343/700 MS

(58) Field of Classification Search ..... 343/700 MS, 343/702, 846

See application file for complete search history.

(56) References Cited

U.S. PATENT DOCUMENTS

| | | | | |
|---|---|---|---|---|
| 5,668,561 | A * | 9/1997 | Perrotta et al. | 343/702 |
| 6,593,887 | B2 | 7/2003 | Luk et al. | 343/700 |
| 6,914,563 | B2 * | 7/2005 | Chen et al. | 343/700 MS |
| 7,215,288 | B2 * | 5/2007 | Park et al. | 343/702 |
| 7,843,389 | B2 * | 11/2010 | Luk et al. | 343/700 MS |
| 7,911,392 | B2 * | 3/2011 | Rao et al. | 343/700 MS |

OTHER PUBLICATIONS

A. Adrian et al, "Dual Aperture-Coupled Microstrip Antenna for Dual or Circular Polarisation", Electronics Letters, vol. 23, No. 23, pp. 1226-1228 (1987).

C.H. Tsao et al., "Aperture-coupled Patch Antennas with Wide-bandwidth and Dual-polarization Capabilities", IEEE Antennas Propagat. Soc. Int. Symp. Dig, vol. 3, pp. 936-939 (1988).

D. M. Pozar et al., "A Dual-Band Circularly Polarized Aperture-Coupled Stacked Microstrip Antenna for Global Positioning Satellite", IEEE Transactions on Antennas and Propagation, vol. 45, No. 11, pp. 1618-1625 (1997).

B. Lindmark et al., "A Novel Dual Polarized Aperture Coupled Patch Element with a Single Layer Feed Network and High Isolation", IEEE Antennas Propagat. Soc. Int. Symp. Dig, vol. 4, pp. 2190-2193 (1997).

H.C. Tung et al., "A Compact Dual-Polarized Patch Antenna for 1800 MHz Band Operation", Microwave and Optical Technology Letters, vol. 29, No. 1, pp. 1-2 (2001).

K. Wong et al., "Broadband Dual-Polarized Aperture-Coupled Patch Antennas With Modified H-Shaped Coupling Slots", IEEE Transactions on Antennas and Propagation, vol. 50, No. 2, pp. 188-191 (2002).

S.C. Gao et al., "Dual-Polarized Slot-Coupled Planar Antenna With Wide Bandwidth", IEEE Transactions on Antennas and Propagation, vol. 51, No. 3 , pp. 441-448 (2003).

S. Gao et al., "Dual Polarized Broad-Band Microstrip Antennas Fed by Proximity Coupling", IEEE Transactions on Antennas and Propagation, vol. 53, No. 1, pp. 526-530 (2005).

K. M. Luk et al., "Broadband microstrip patch antenna", Electronics Letters, vol. 34, No. 15, pp. 1442-1443 (1998).

C.L. Mak et al., "Experimental Study of a Microstrip Patch Antenna with an *L*-Shaped Probe", IEEE Transactions on Antennas and Propagation, vol. 48, No. 5, pp. 777-783 (2000).

(Continued)

*Primary Examiner* — Huedung Mancuso
(74) *Attorney, Agent, or Firm* — Ostrolenk Faber LLP

(57) ABSTRACT

The present invention provides a patch antenna comprising a patch spaced from a ground plane and two L-shaped feed probes. Each feed probe is connected to a respective input port and has a portion extending parallel to the patch. The antenna further includes at least two walls extending from the ground plane towards the patch. The walls are positioned between the L-shaped feed probes so as to permit direct propagation between the input ports and also to create indirect diffraction paths between the input ports that serve to cancel at least a part of said direct propagation.

7 Claims, 12 Drawing Sheets

OTHER PUBLICATIONS

Yong-Xin Guo et al., "Analysis and Design of L-Probe Proximity Fed-Patch Antennas", IEEE Transactions on Antennas and Propagation, vol. 49, No. 2, pp. 145-149 (2001).

H. Wong et al., "A Dual-polarized L-probe Patch Antenna", Microwave Conference, Asia-Pacific, vol. 2, pp. 930-933 (2001).

K.L. Lau, et al., "A Wide-Band Dual-Polarization Patch Antenna With Directional Coupler", IEEE Antennas and Wireless Propagation Letters, vol. 1, pp. 186-189 (2002).

H. Wong et al., "Design of a Dual-Polarized L-Probe Patch Antenna Arrays With High Isolation", IEEE Transactions on Antennas and Propagation, vol. 52, No. 1, pp. 45-52 (2004).

* cited by examiner

ISOLATION ENHANCEMENT TECHNIQUE FOR DUAL-POLARIZED PROBE-FED PATCH ANTENNA

FIELD OF THE INVENTION

The invention relates to an isolation enhancement technique that can be used in any type of dual-polarized patch antenna with feeding probes.

BACKGROUND OF THE INVENTION

Polarization diversity is widely used for base stations to solve the problem of multi-path fading at the receiving antennas. Traditionally this is implemented by using two offset perpendicular slots or two centered crossed slots at the ground plane to excite the patch in orthogonal directions, where these slots are rectangular in shape.

For an antenna with offset slots only a simple feeding network is required. However, such an antenna has poor input port isolation of around 18 dB which cannot satisfy current requirements for mobile communication applications. Indeed, isolation of more than 30 dB is one of the criteria for a dual-polarized antenna to provide a reasonable level of diversity gain.

For an antenna with crossed slots, this criterion can be satisfied by using a pair of balanced microstriplines to feed each slot. Nevertheless, this needs a complex feeding network that consists of an air-bridge. In order to obtain high isolation with a simple feeding network, two offset H-shaped (or modified H-shaped) slots are used to excite the patch for orthogonal polarizations. This antenna can acquire an isolation of more than 30 dB over a wide impedance bandwidth of around 20%. Most dual-polarized patch antenna designs are based on the slot/aperture feeding method. They do not involve the probe feeding method due to the strong coupling between the vertical metallic parts of the feeding probes.

PRIOR ART

As an alternative to dual-polarized patch antennas based on the slot/aperture feeding method a feeding method using an "L-shaped probe" has become known as described for example in U.S. Pat. No. 6,593,887. Compared to the slot/aperture feeding method, the dual-polarized L-shaped probe patch antenna has the additional features of lower back radiation, wider impedance bandwidth and higher gain. However, this antenna has poorer input port isolation due to the strong coupling between the vertical metallic parts of the feeding probes. Some methods have been proposed to solve this problem. Unfortunately, these methods either have the drawback of narrow isolation bandwidth or complex structure.

As is well known, an L-shaped feeding probe (K. M. Luk, C. L. Mak, Y. L. Chow, and K. F. Lee, "*Broad-band microstrip patch antenna", Electron. Lett, Vol.* 34, (15), pp. 1442-1443, 1998.) has numerous desirable features compared to the other feeding methods such as non-contacting feed transition and is easy to fabricate. Such a design also provides an excellent feed for a patch antenna with a thick substrate (thickness ~$0.1\lambda_0$) (C. L. Mak K. M. Luk, K. F. Lee, and Y. L. Chow, "*Experimental study of a microstrip patch antenna with an L-shaped probe", IEEE Trans. Antennas Propag, Vol.* 48, (5), pp. 777-783, 2000; Y. X. Guo, C. L. Mak, K. M. Luk and K. F. Lee, "*Analysis and design of L-probe proximity fed-patch antennas", IEEE Trans. Antennas Propag, Vol.* 49, (2), pp. 145-149, 2001.). In order to develop a dual-polarized patch antenna with these features, a pair of L-probes is utilized to excite the square patch orthogonally (H. Wong, K. B. Ng, and K. M. Luk, "*A dual-polarized L-probe patch antenna", Microwave Conference,* 2001 *Asia-Pacific, Vol.* 2, pp. 930-933, 2001.) However, poor isolation of less than 30 dB is reported between the input ports. In the literature, two techniques have been proposed to improve the isolation to more than 30 dB. The first uses a directional coupler (K. L. Lau, K. M. Luk, and D. Lin, "*A wide-band dual-polarization patch antenna with directional coupler", IEEE Antennas and Wireless Propagation Letters, vol.* 1, (10), pp. 186-189, 2002), which is mounted at the back of the ground plane, to feed the pair of L-probes in Wong et al. Although this antenna has a simple structure, it has narrow isolation bandwidth ($S_{21} \leqq -30$ dB) of 13%. The second one utilizes two pairs of L-probes to excite the patch in orthogonal directions (H. Wong, K. L. Lau, and K. M. Luk, "*Design of dual polarized L-probe patch antenna arrays with high isolation", IEEE Trans. Antennas Propag, vol.* 52, (1), pp. 45-52, 2004). This has the advantage of wide isolation bandwidth of 31%, but the drawback is a complex structure.

SUMMARY OF THE INVENTION

According to the present invention there is provided a patch antenna comprising a patch spaced from a ground plane and two L-shaped feed probes each said feed probe having being connected to a respective input port and having a portion extending parallel to the patch, and at least two walls extending from said ground plane towards said patch, said walls being positioned between said L-shaped feed probes.

In preferred embodiments of the invention two vertical walls are provided along a line extending at 45° to each said feed probe.

The feed probes may be arranged to extend orthogonally with respect to the sides of a square said patch and the walls extend along a line that is diagonal relative to the patch, or alternatively the feed probes may be provided at respective corners of a square patch and extend along diagonals relative to the patch, with the walls extending along a line disposed centrally with respect to the square patch.

Preferably each wall has the same height measured from the ground plane towards the patch, and one wall is longer than the other wall measured in a direction parallel to the ground plane.

In preferred embodiments of the invention the vertical walls are positioned so as to permit direct propagation between the input ports. In particular the vertical walls may bee positioned such as to create indirect diffraction paths between said input ports, the indirect paths serving to cancel at least a part of the direct propagation.

BRIEF DESCRIPTION OF THE DRAWINGS

Some embodiments of the invention will now be described by way of example and with reference to the accompanying drawings, in which.

DETAILED DESCRIPTION OF PREFERRED EMBODIMENTS

An object of the present invention is to provide a novel isolation enhancement technique for dual-polarized patch antennas that use a probe feeding method. This technique not only can retain the features of the probe feeding method, but also can remove its drawbacks. For the design of a dual-polarized patch antenna array with feeding probes, this technique can be used to reduce the strong coupling between the feeding probes of different polarizations within each array element and between different array elements. As a result, high input port isolation can be acquired over a wide range of frequencies.

The present invention at least in preferred embodiments therefore provides an isolation enhancement technique that can be used in any type of dual-polarized patch antenna that employs a probe feeding method such as coaxial probe feed, L-shaped probe feed, etc. This technique is implemented by mounting vertical walls on the ground plane. These walls are located beneath the diagonal axis of the patch between the feeding probes. By optimizing their dimensions and positions, the input port isolation of the dual-polarized patch antenna can be enhanced dramatically over a wide range of frequencies.

Figure 1:
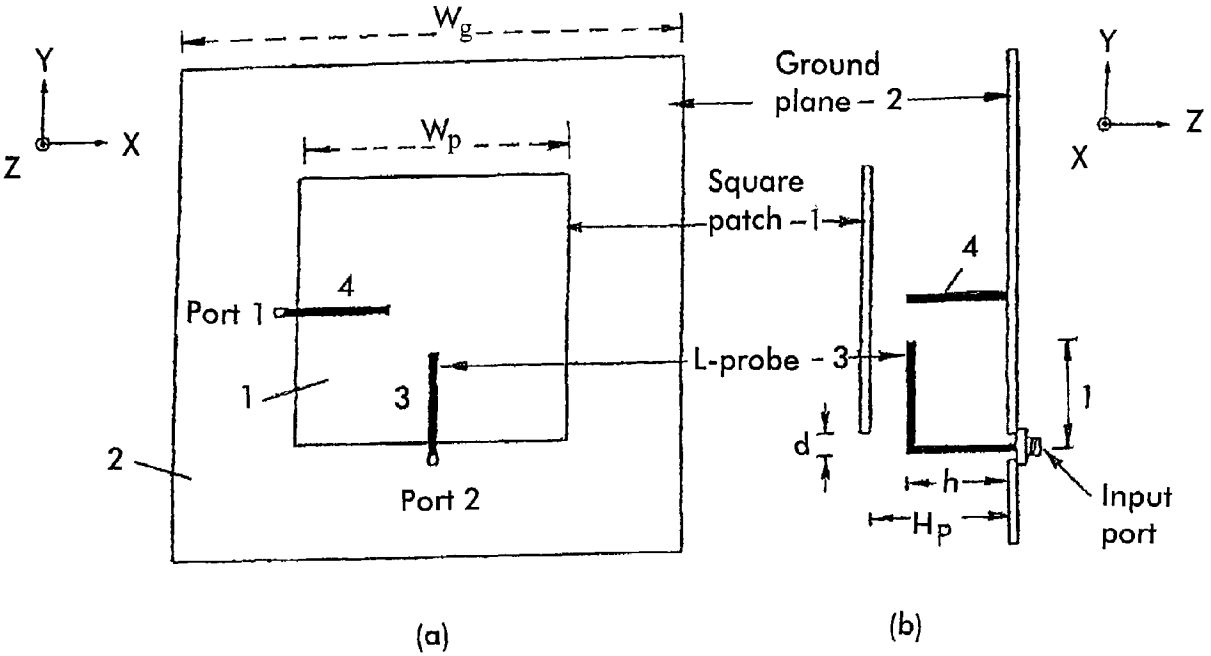
FIG. 1 shows (a) a top view and (b) a side view of an example of the prior art.

In order to explain the operating principle of this technique, the performance of a dual-polarized L-probe fed patch antenna will firstly be described. The geometry of the antenna according to the prior art is shown in FIG. 1. This antenna consists of a square patch 1 that is supported by four plastic posts (not shown) above a square ground plane 2. The patch is excited by a pair of L-probes 3, 4 that are disposed in orthogonal directions. Let λ be the free space wavelength at 890 MHz such that λ=337.1 mm. The L-probes have a diameter of 1 mm ($0.003\lambda_0$). Thicknesses of the patch and the ground plane are both 2 mm ($0.006\lambda_0$). The other dimensions are as follows:

Typical data: (all dimensions are shown as mm.) λ=337.1 mm for center frequency of 890 MHz

| $H_p$ | $W_p$ | h | l | d | $W_g$ |
|---|---|---|---|---|---|
| 36.3 (0.108λ) | 126.5 (0.375λ) | 20.6 (0.061λ) | 64.9 (0.193λ) | 3.1 (0.009λ) | 261.6 (0.776λ) |

Figure 2:
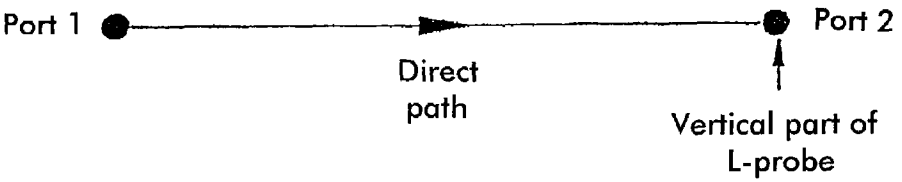
FIG. 2 illustrates the direct wave propagation between the vertical arms of the probes in the prior art.

The performance of this antenna is calculated by the commercial simulation software "IE3D" (Zeland Software Inc, Version 9.35.). The standing wave ratio and input port coupling are depicted by the broken lines in FIG. 5. It is clearly seen that high input port coupling of −6.5 dB is observed across the impedance bandwidth (SWR≦1.5) of 25%, which ranges from 780 to 1000 MHz. In fact, the vertical parts of the L-probes are equivalent to short monopoles. They will generate electromagnetic waves propagating in all directions (omni-directional) along the ground plane. Since these parts are parallel and close to each other, the input port coupling is mainly due to the wave propagation through the direct path between the L-probes for different polarizations as depicted in FIG. 2.

Figure 3:
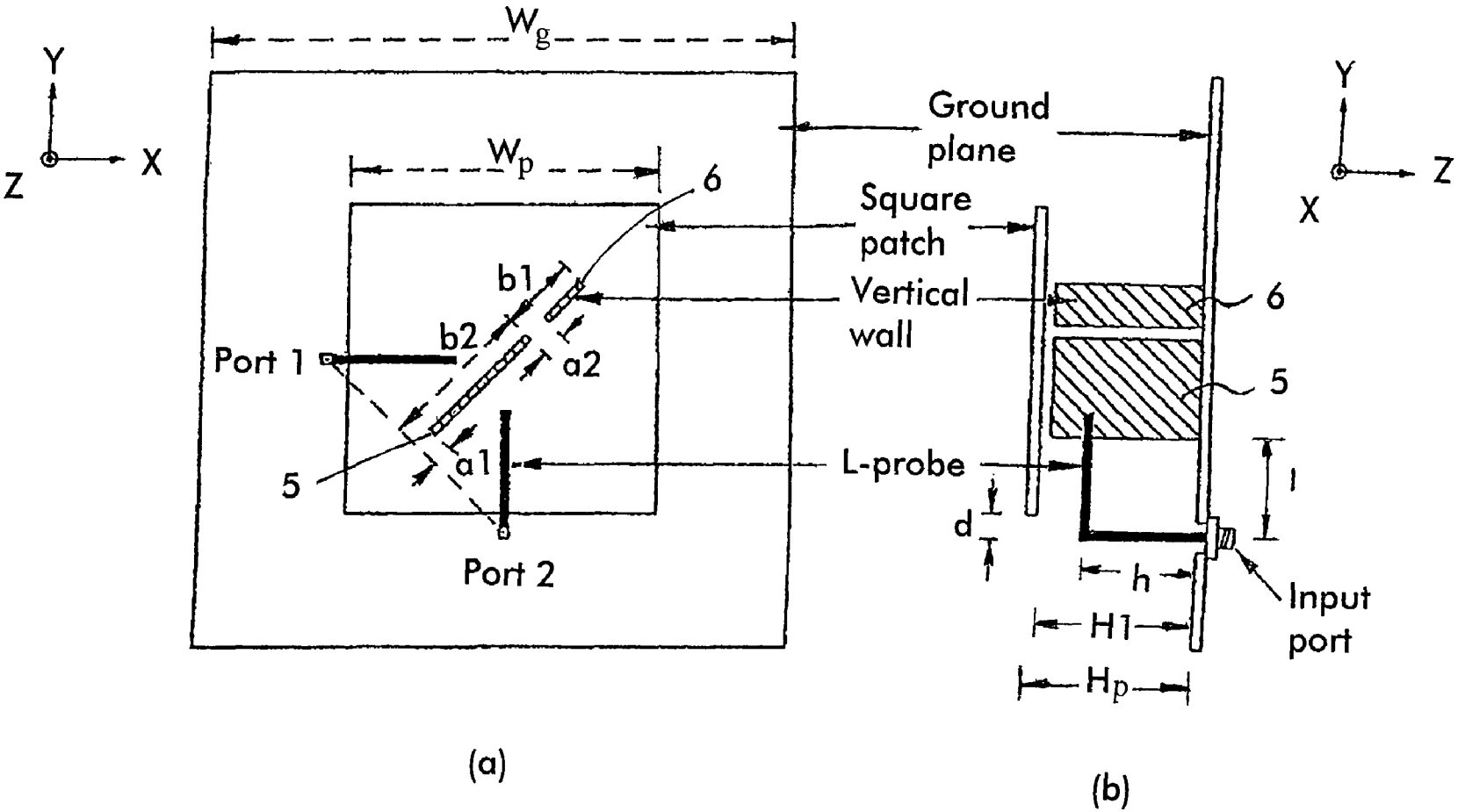
FIG. 3 shows (a) a top view and (b) a side view of an embodiment of the invention.

The input port coupling can be reduced significantly by mounting two vertical walls 5, 6 on the ground plane as depicted in FIG. 3. The two walls are formed of conducting material. Vertical wall 5 is longer than vertical wall 6 and in particular the length of the vertical wall 5 is between 0.14λ and 0.20λ, while the length of the vertical wall 6 is between 0.0λ and 0.07λ. Both walls have the same height which is at least equal to 0.01λ but less than the spacing between the ground plane and the patch (the vertical walls do not touch the patch). The vertical walls 5, 6 extend along the diagonal that extends across the patch making a 45° angle to each L-shaped probe.

Figure 4:
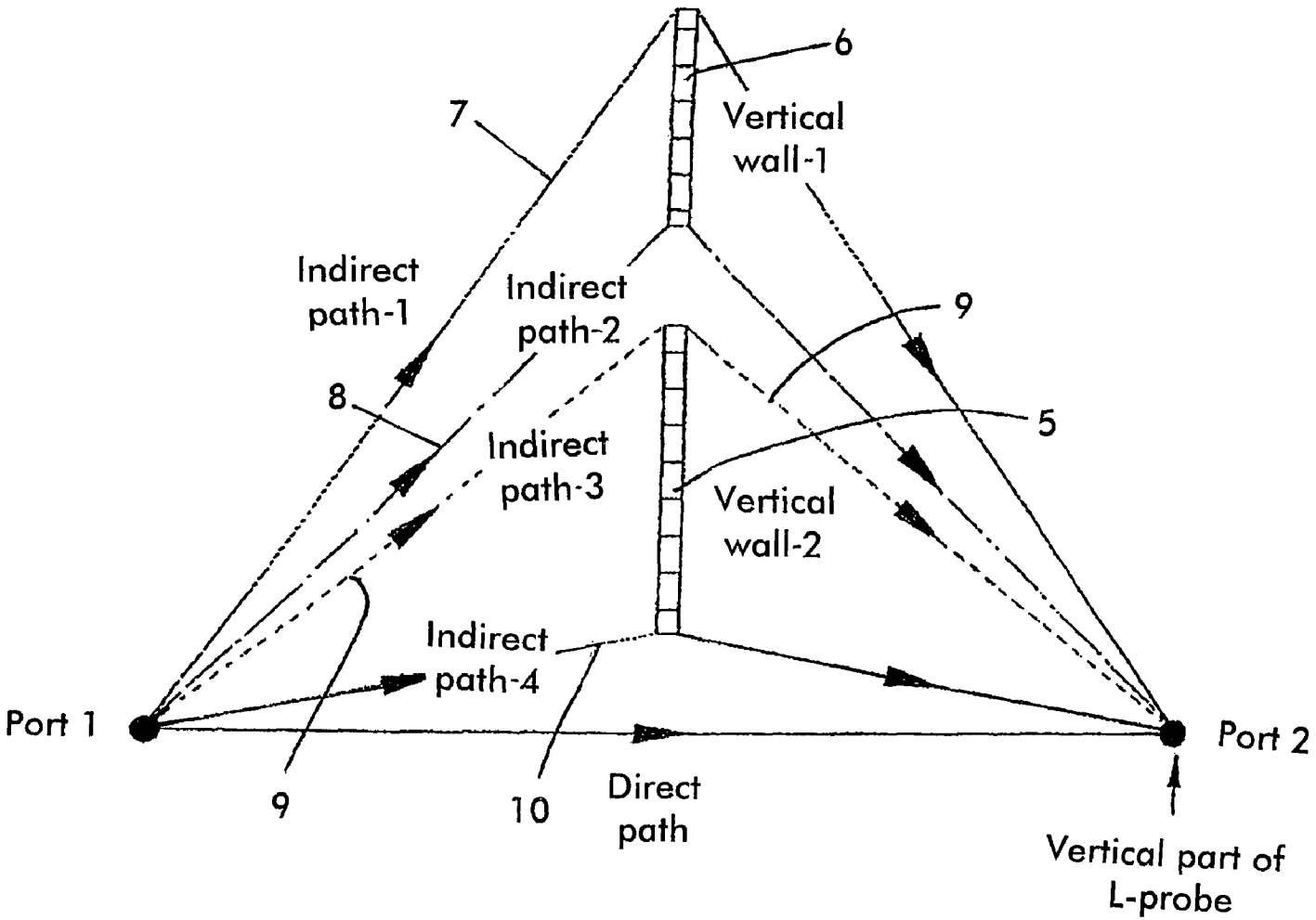
FIG. 4 illustrates the direct and indirect wave propagations between the vertical arms of the L-probes in the embodiment of FIG. 3, FIG. 5 plots the simulated standing wave ratio and input port coupling of antennas according to the prior art and according to embodiments of the present invention, FIG. 6 plots for (a) Port 1 and (b) Port 2 standing wave ratio and gain against frequency of an antenna according to an embodiment of the invention, FIG. 7 plots input port coupling against frequency for an antenna according to an embodiment of the invention, FIG. 8 plots for (a) Port 1 and (b) Port 2 horizontal-plane radiation patterns at 890 MHz for an antenna according to an embodiment of the invention, FIG. 9 plots for (a) Port 1 and (b) Port 2 vertical-plane radiation patterns at 890 MHz for an antenna according to an embodiment of the invention.

It should be noted that the longer wall 5 does not block the wave propagation through the direct path. In contrast, they will create four indirect paths due to the diffractions at their upper edges (indirect paths 7 and 9) and lower edges (indirect paths 8 and 10) as shown in FIG. 4. If the wall 5 were to block the direct propagation the indirect paths 8 and 9 would combine (since they will be in phase) to form a sum similar in magnitude to the direct propagation and therefore there would be little isolation enhancement (only about 2.3 dB). By optimizing the positions and dimensions of the two vertical walls, and by not blocking the direct path, the waves propagated through the direct path and indirect paths can cancel each other to a certain extent and as a result the input port coupling reduced. The dimensions of this antenna are as follows:

Typical data: (all dimensions are shown as mm.) λ=337.1 mm for center frequency of 890 MHz

| $H_p$ | $W_p$ | h | l | d | $W_g$ | H1 | a1 | b1 | a2 | b2 |
|---|---|---|---|---|---|---|---|---|---|---|
| 36.3 (0.108λ) | 124 (0.368λ) | 23.6 (0.07λ) | 57.5 (0.171λ) | 4.3 (0.013λ) | 261.6 (0.776λ) | 34.5 (0.102λ) | 16.3 (0.048λ) | 74.6 (0.221λ) | 10.5 (0.031λ) | 24 (0.071λ) |

Figure 5:
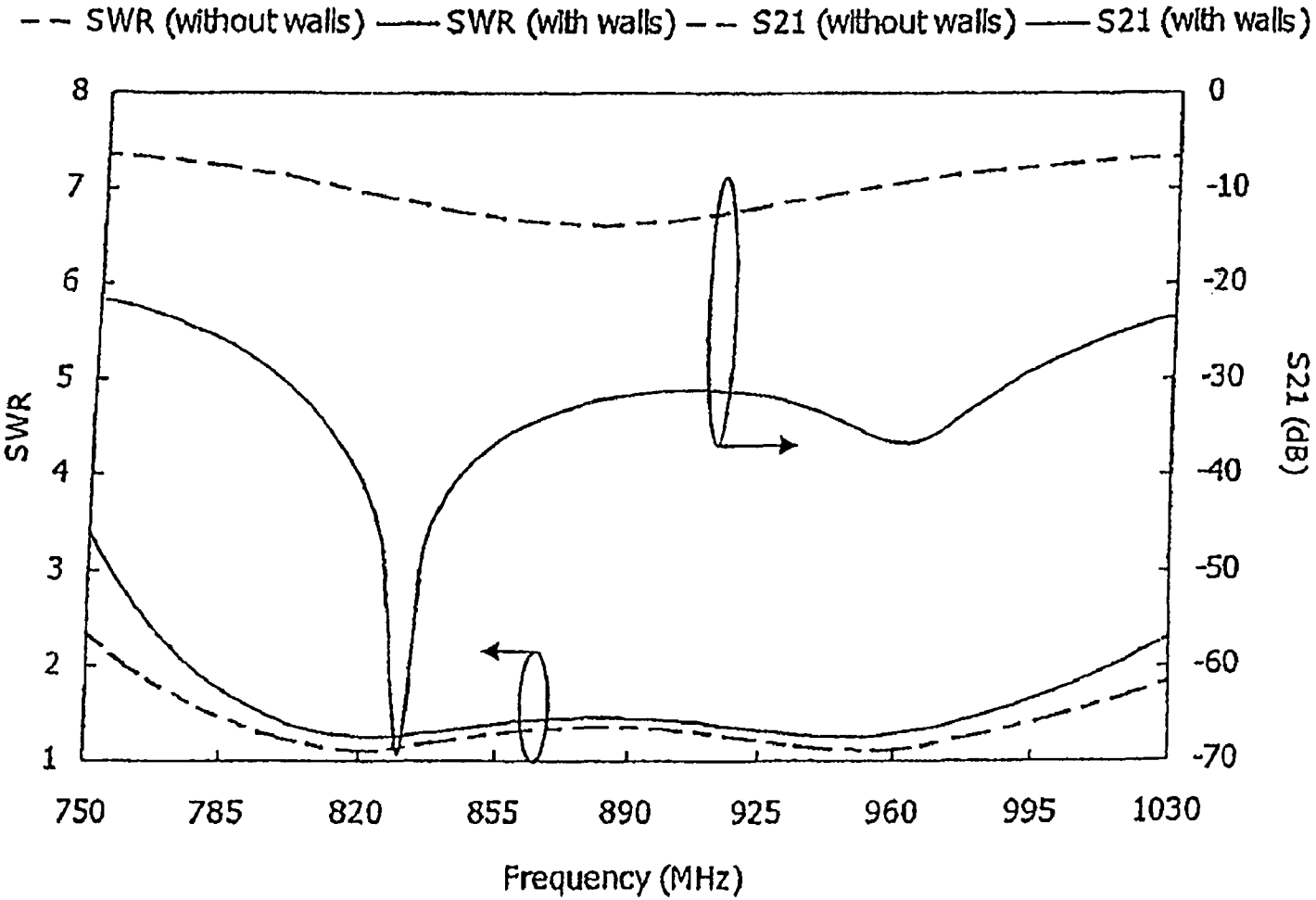

The standing wave ratio and input port coupling are depicted by the solid lines in FIG. 5. It can be seen from FIG. 5 that the input port coupling is −30 dB across the impedance bandwidth (SWR≦1.5) of 21% which ranges from 796 to 983 MHz. Although the impedance bandwidths (SWR≦1.5) of both input ports are slightly reduced from 25% (780 to 1000 MHz) to 21% (796 to 983 MHz) with the presence of the two vertical walls, the input port coupling is dramatically reduced from −6.5 dB to −30 dB across the impedance bandwidth (SWR≦1.5). The reduction in coupling is 23.5 dB.

Figure 6A:
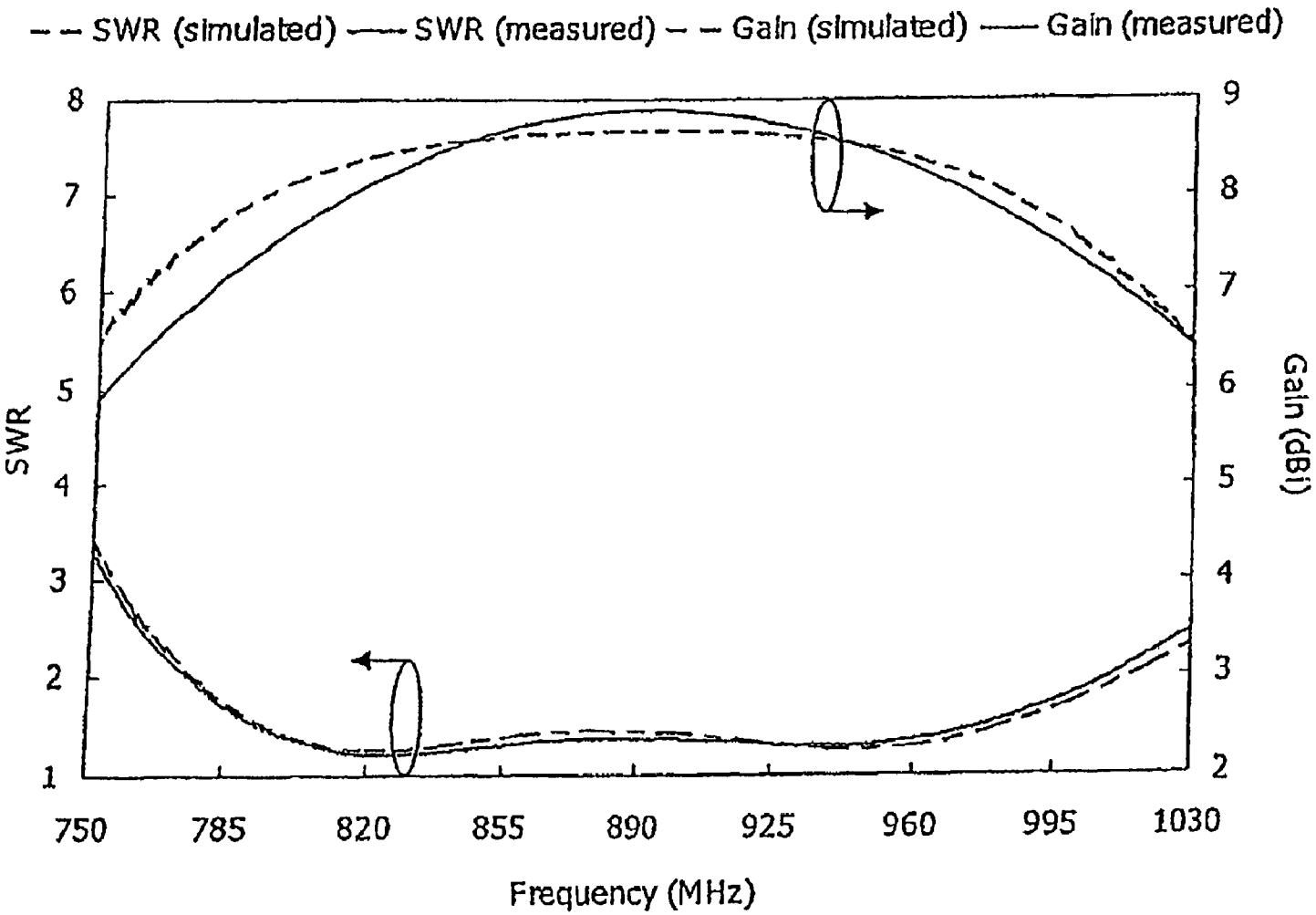
Figure 6B:
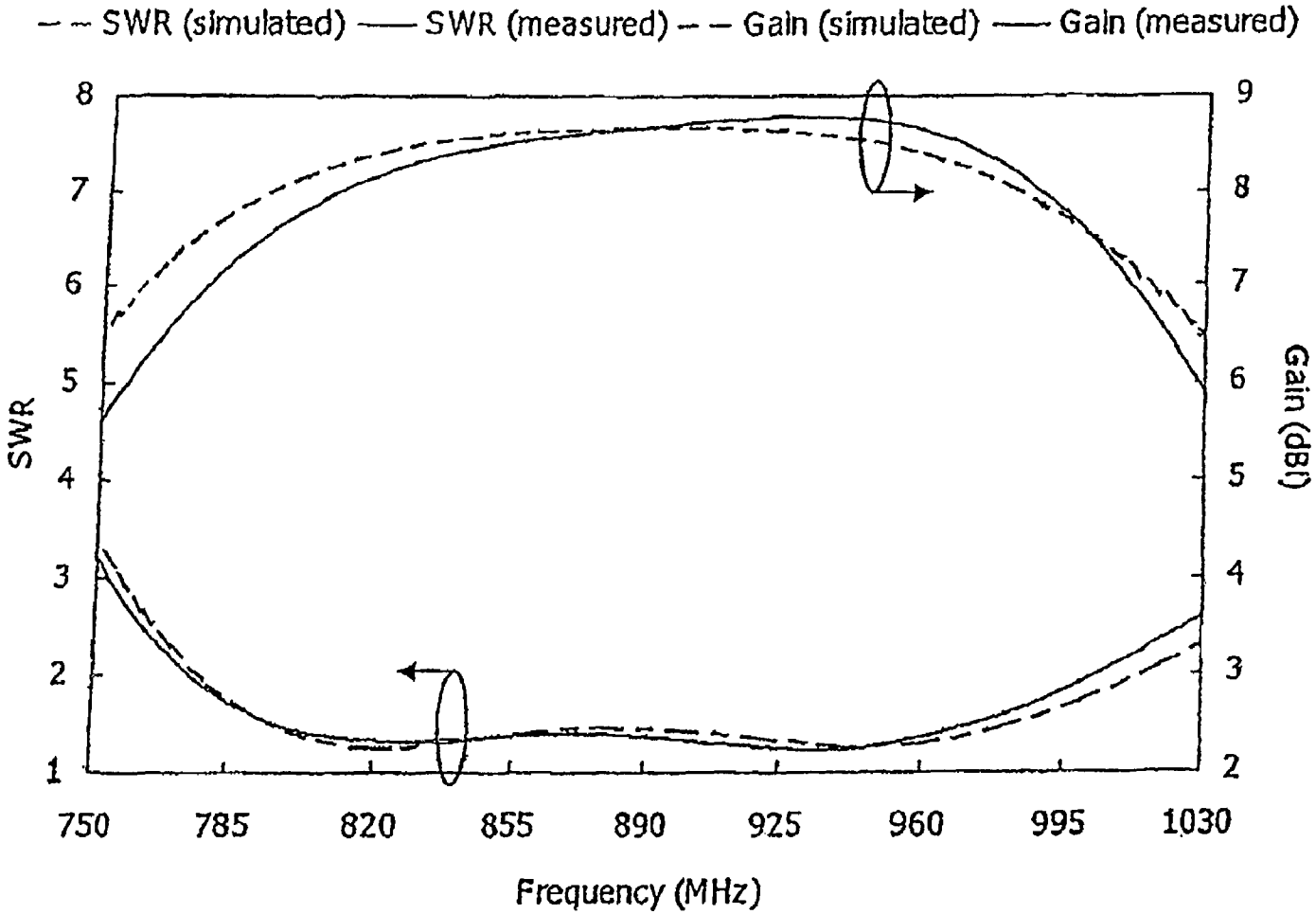
Figure 7:
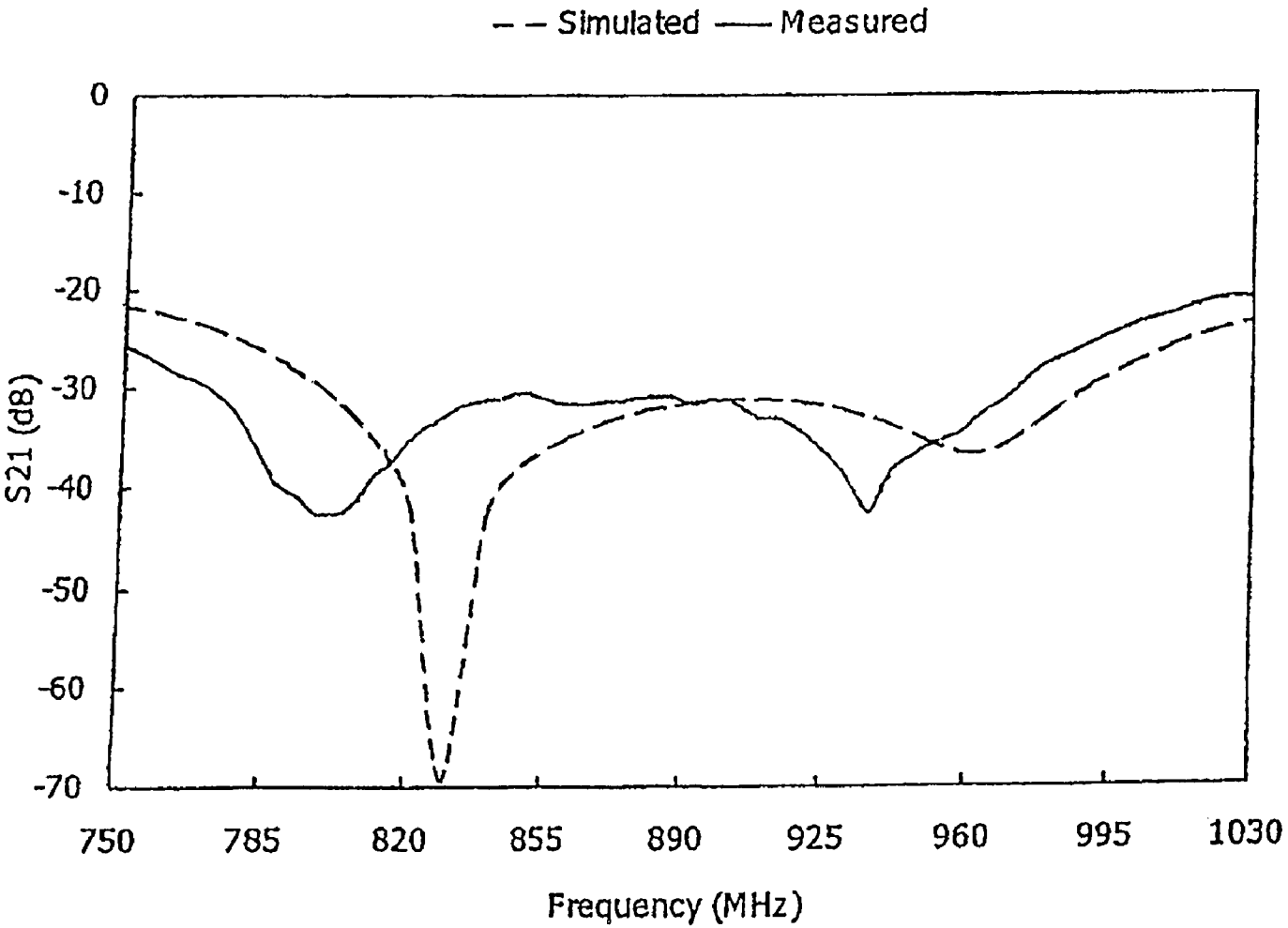

Other than simulation, the performance of the antenna according to the embodiment of FIG. 3 was measured. The standing wave ratio and gain against frequency curves for Port 1 and Port 2 are shown in FIGS. 6(*a*) and 6(*b*), respectively. From the SWR curves, it is clearly seen that this antenna has two minima for each input port. Since they are close to each other, wide simulated impedance bandwidth (SWR≦1.5) of 21% (796 to 983 MHz) is acquired for both input ports. Also, wide measured impedance bandwidths (SWR≦1.5) of 21% (794 to 977 MHz) and 20% (796 to 974 MHz) are obtained for Port 1 and Port 2, respectively. In the same figure, it can be observed that the simulated 3 dB gain bandwidth is 35% (738 to 1047 MHz) for both input ports. Moreover, the measured 3 dB gain bandwidths are 33% (753 to 1047 MHz) for Port 1 and 31% (754 to 1032 MHz) for Port 2, correspondingly. For both ports, the simulated peak gain and average gain are 8.7 dBi and 8.5 dBi, respectively. The measured peak gain and average gain are around 8.8 dBi and 8.4 dBi, correspondingly. The input port coupling against frequency curve is displayed in FIG. 7. It is clearly seen that the simulated and measured isolation bandwidths ($S_{21}$≦−30 dB) are 22% (794 to 986 MHz) and 23% (771 to 973 MHz), respectively.

Figure 8A:
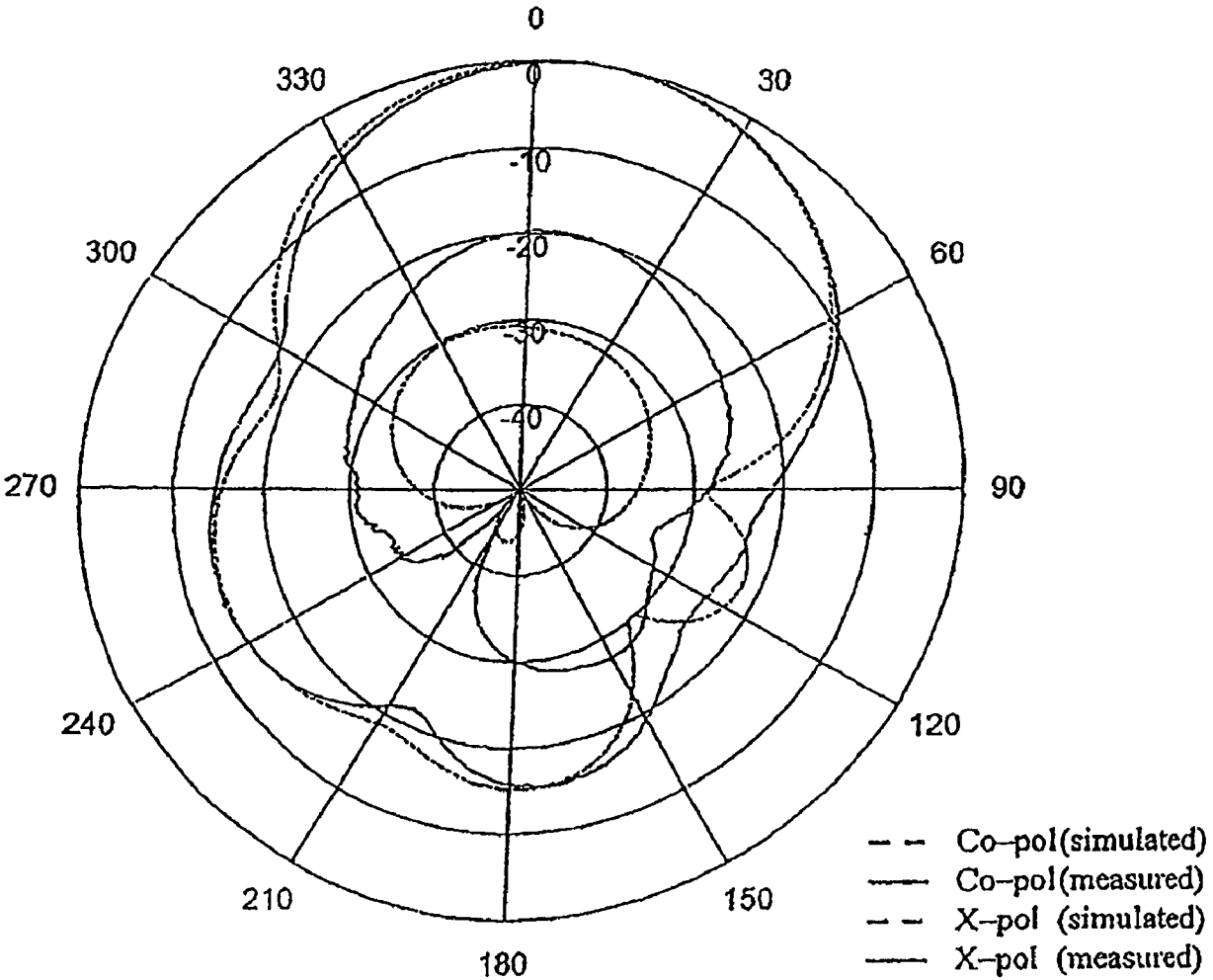
Figure 8B:
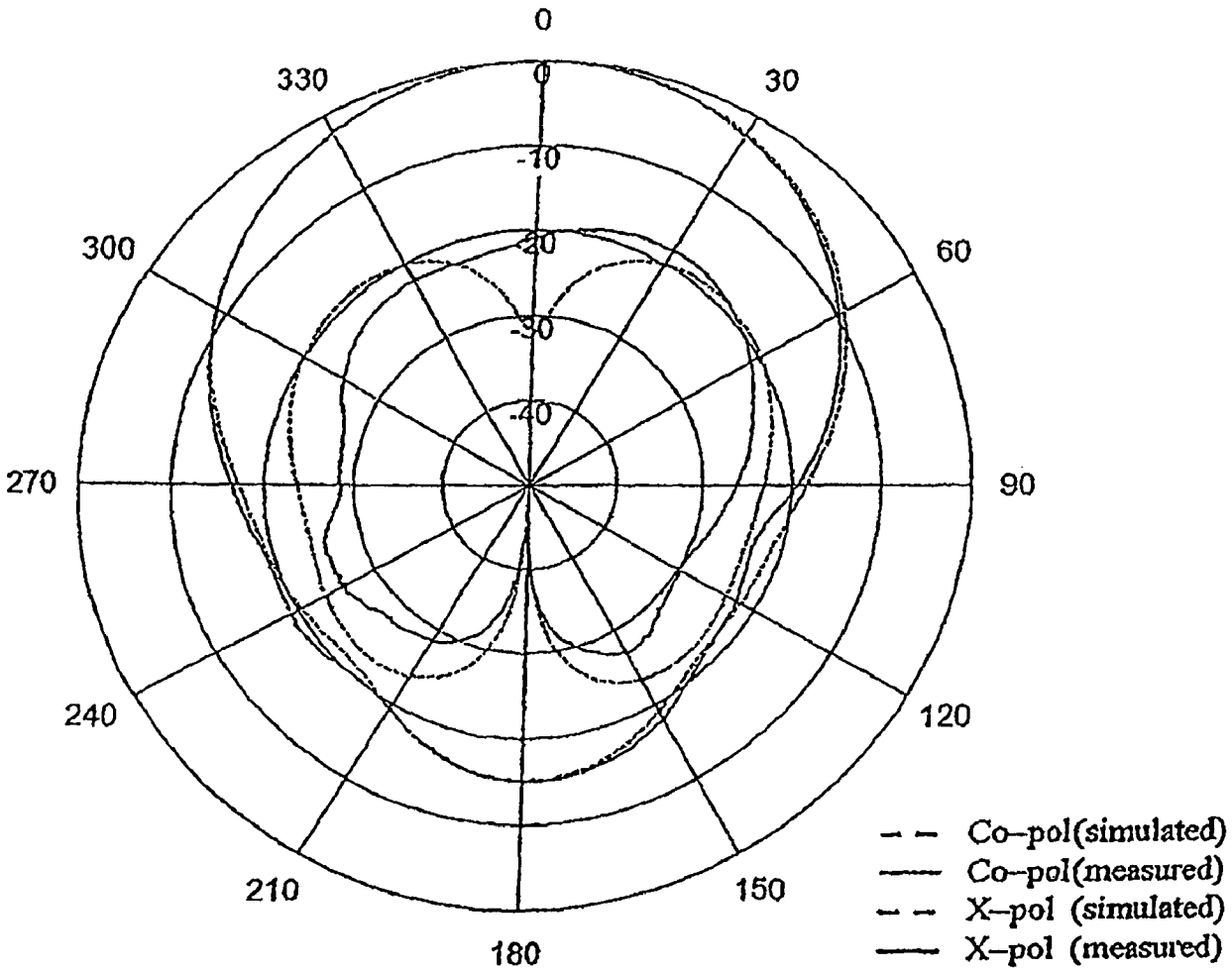
Figure 9A:
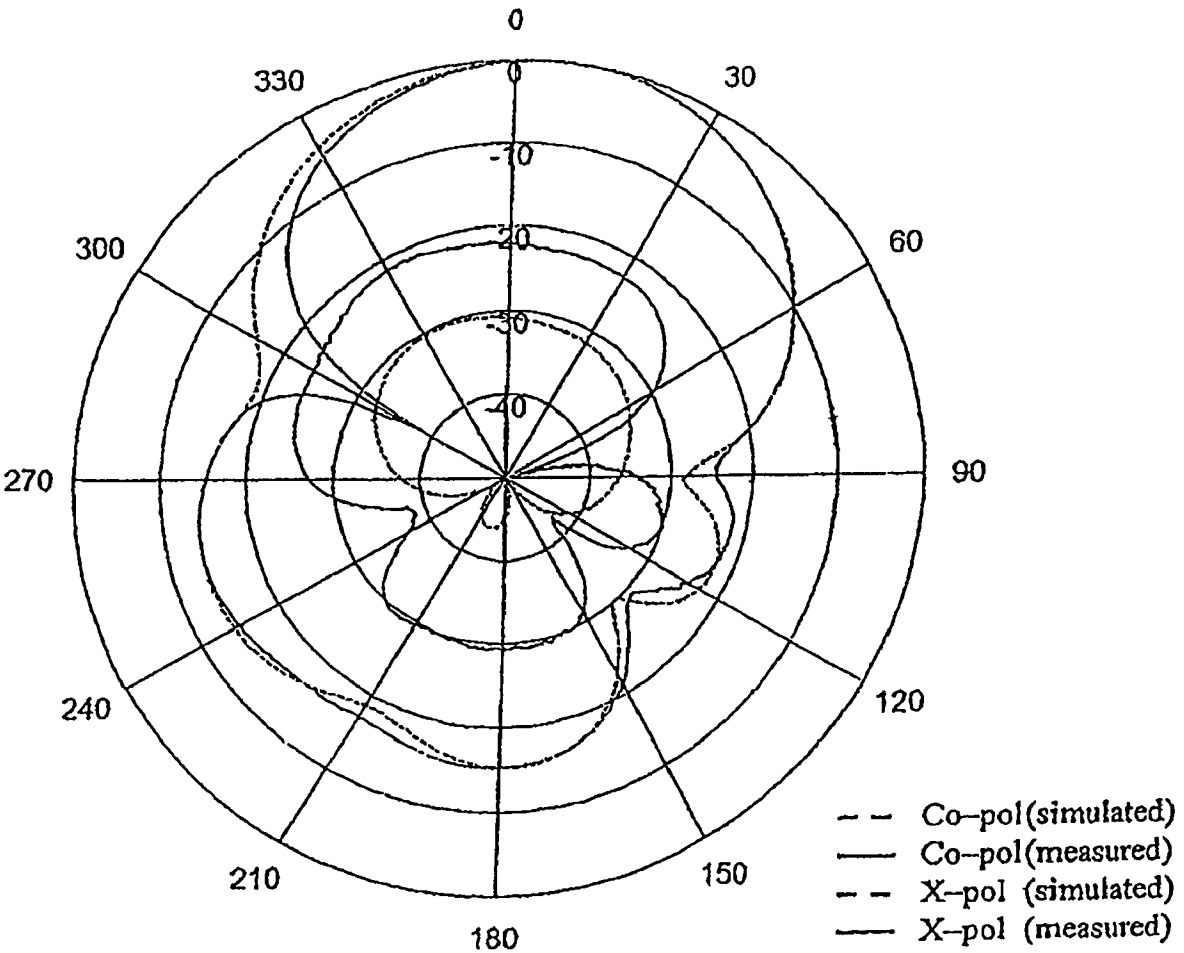
Figure 9B:
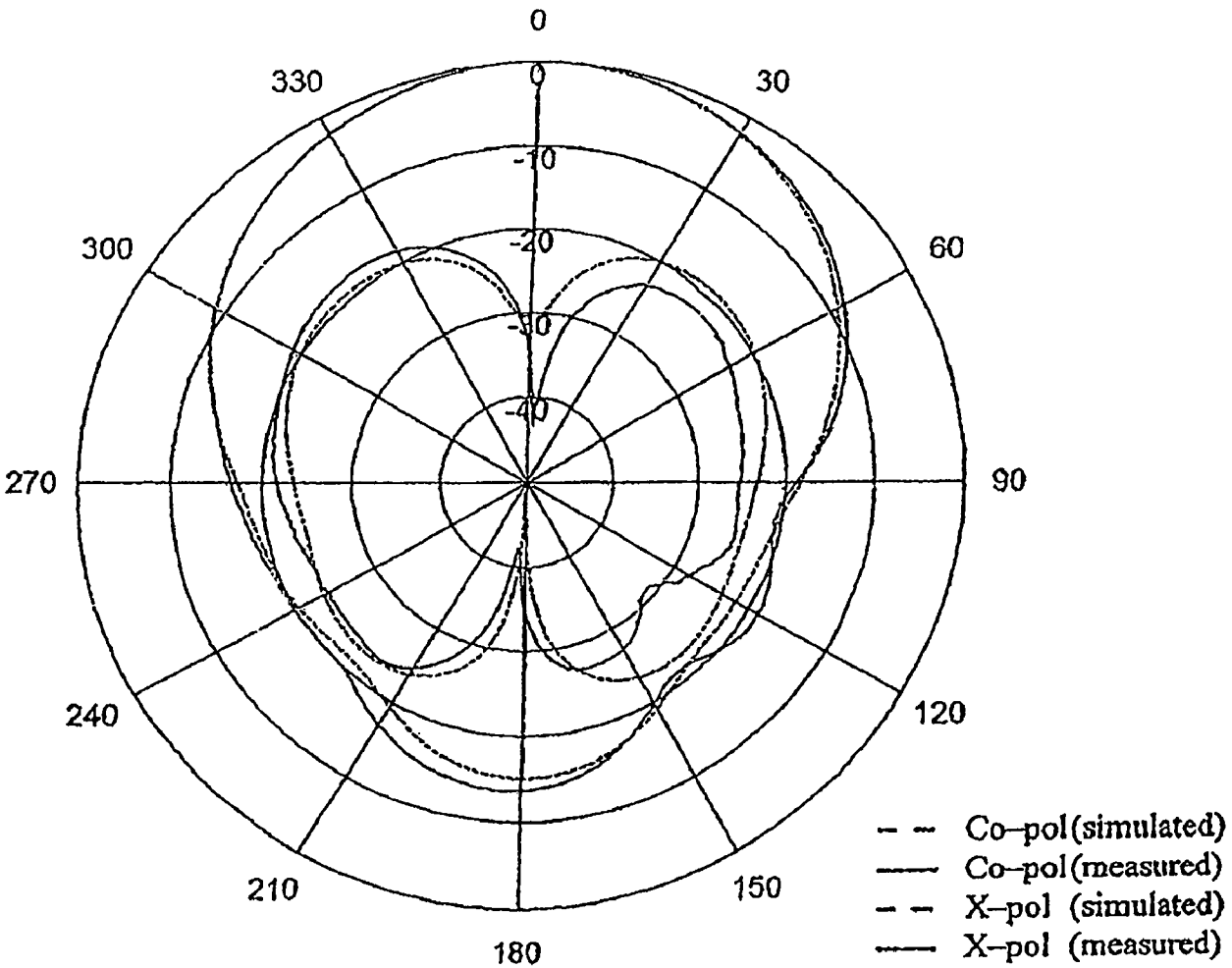

The horizontal-plane radiation patterns for both ports at 890 MHz are shown in FIGS. 8(*a*) and 8(*b*). For the simulated co-polarization components, the 3 dB beamwidths are 60° and 68° for Port 1 and Port 2, respectively. The cross-polarization levels are lower than −16.5 dB over the 3 dB beamwidths. For the measured co-polarization components, the 3 dB beamwidths are 57° and 66° for Port 1 and Port 2, respectively. Their cross-polarization levels are lower than −18.3 dB over the 3 dB beamwidths. The vertical-plane radiation patterns for both ports at 890 MHz are shown in FIGS. 9*a* and 9*b*. For the simulated co-polarization components, the 3 dB beamwidths are 68° and 60° for Port 1 and Port 2, respectively. The cross-polarization levels are lower than −16.5 dB over the 3 dB beamwidths. For the measured co-polarization components, the 3 dB beamwidths are 70° and 56° for port 1 and port 2, respectively. Their cross-polarization levels are lower than −18.1 dB over the 3 dB beamwidths.

In the embodiment described above two vertical walls are provided. Experimental results have shown that if only a single vertical wall is provided then provided that it is located at the correct position it can enhance the isolation but only by a few decibels. Using two vertical walls as described above allows for a much more significant enhancement of the isolation (up to ~23.5 dB). Using more than two vertical walls is also possible.

Figure 10:
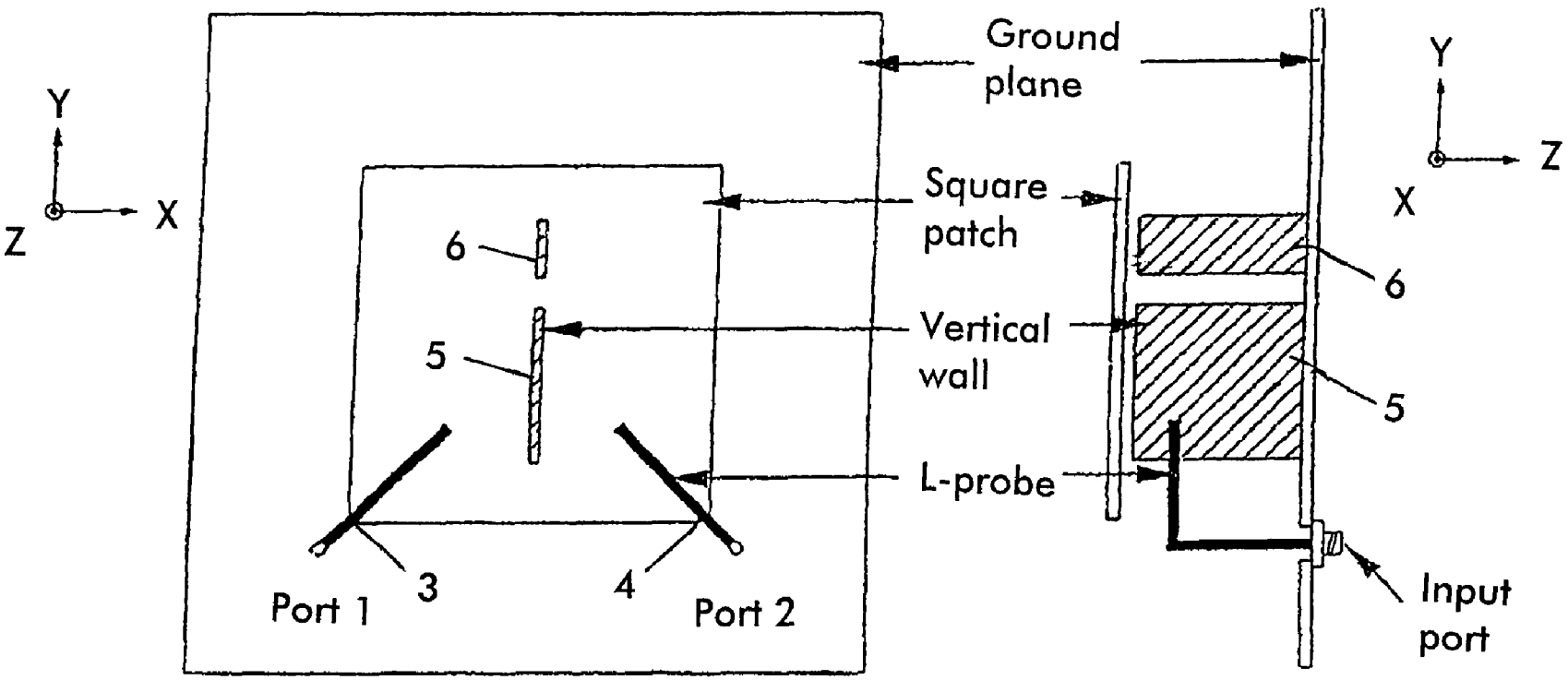
FIG. 10 shows an alternative embodiment of the invention.

In the embodiment shown in FIG. 3 the two L-shaped feed probes 3, 4 extend at right angles to the sides of the square patch 1 and the vertical walls 5, 6 extend along a diagonal of the square patch 1. Other arrangements are possible, however, and on example is shown in FIG. 10. In the embodiment of FIG. 10 the feed probes 3, 4 are provided at two corners of the square patch and extend along two respective diagonals. The two vertical walls 5, 6 then extend along a line that is disposed centrally with respect to the square patch 1 and is parallel to two opposed sides of the patch 1 and perpendicular to the remaining sides such that the vertical walls 5, 6 are on a line that makes an angle of 45° to the two diagonals and the two feed probes 3, 4.

It will thus be seen that the novel isolation enhancement technique presented here has many features, including being simple to implement, low cost and effective in enhancing isolation. The technique only requires mounting thin and small vertical walls on the ground plane and does not need a feeding network. The technique can enhance the input port isolation of any type of dual-polarized probe-fed patch antenna dramatically over a wide range of frequencies. Consequently, this technique is very useful in the design of various types of dual-polarized patch antennas with feeding probes.

The invention claimed is:

1. A patch antenna comprising a patch spaced from a ground plane and two L-shaped feed probes each said feed probe having being connected to a respective input port and having a portion extending parallel to the patch, and at least two walls extending from said ground plane towards said patch, said walls being positioned between said L-shaped feed probes.

2. An antenna as claimed in claim 1 wherein two vertical walls are provided along a line extending at 45° to each said feed probe.

3. An antenna as claimed in claim 2 wherein said feed probes extend orthogonally with respect to the sides of a square said patch and wherein said walls extend along a line that is diagonal relative to said patch.

4. An antenna as claimed in claim 2 wherein said feed probes are provided at respective corners of a square patch and extend along diagonals relative to said patch, and wherein said walls extend along a line disposed centrally with respect to said square patch.

5. An antenna as claimed in claim 1 wherein each said wall has the same height measured from the ground plane towards said patch, and wherein one wall is longer than the other wall measured in a direction parallel to the ground plane.

6. A patch antenna as claimed in claim 1 wherein said vertical walls are positioned so as to permit direct propagation between said input ports.

7. A patch antenna as claimed in claim 6 wherein said vertical walls are positioned such as to create indirect diffraction paths between said input ports, said indirect paths serving to cancel at least a part of said direct propagation.

* * * * *